US008445073B2

(12) United States Patent
Jacobson et al.

(10) Patent No.: US 8,445,073 B2
(45) Date of Patent: May 21, 2013

(54) EDGE COATED ROLL OF TAPE AND METHOD OF MAKING SAME

(75) Inventors: John R. Jacobson, Newport, MN (US); Russell P. Hazard, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 674 days.

(21) Appl. No.: 12/609,741

(22) Filed: Oct. 30, 2009

(65) Prior Publication Data

US 2010/0047530 A1 Feb. 25, 2010

Related U.S. Application Data

(63) Continuation of application No. 09/808,584, filed on Mar. 14, 2001, now Pat. No. 7,669,547.

(51) Int. Cl.
*B05D 1/28* (2006.01)

(52) U.S. Cl.
USPC ..... 427/428.14

(58) Field of Classification Search
USPC ..... 427/428.14
See application file for complete search history.

(56) References Cited

U.S. PATENT DOCUMENTS

| | | | | |
|---|---|---|---|---|
| 2,035,650 | A * | 3/1936 | Gustafson | 156/499 |
| 2,195,101 | A * | 3/1940 | Swab | 118/668 |
| 2,333,172 | A | 11/1943 | Grupe | |
| 2,442,407 | A | 6/1948 | Gibbons et al. | |
| 2,868,162 | A | 1/1959 | Knain | |
| 3,081,191 | A | 3/1963 | Smith et al. | |
| 3,377,202 | A | 4/1968 | Belove | |
| 3,818,860 | A | 6/1974 | Rebentisch | |
| 4,238,269 | A | 12/1980 | Deering, Jr. | |
| 4,299,164 | A | 11/1981 | Jonkers | |
| 4,444,147 | A * | 4/1984 | Dahlgren et al. | 118/261 |
| 4,493,857 | A * | 1/1985 | Knigge et al. | 430/271.1 |
| 4,946,728 | A | 8/1990 | Ikeda et al. | |
| 4,949,667 | A | 8/1990 | Yoshida et al. | |
| 5,209,179 | A | 5/1993 | Herbert et al. | |
| 5,476,545 | A | 12/1995 | Schrauwers et al. | |
| 5,501,147 | A | 3/1996 | Jaffa et al. | |
| 5,628,826 | A | 5/1997 | Prasad | |
| 5,693,404 | A | 12/1997 | Shiraishi et al. | |

(Continued)

FOREIGN PATENT DOCUMENTS

| | | |
|---|---|---|
| CA | 1196181 | 11/1985 |
| EP | 0 645 223 A1 | 3/1995 |

(Continued)

OTHER PUBLICATIONS

Webster's II New Riverside University Dictionary (c) 1984, Houghton Mifflin Company, p. 746, definition of meter.*

(Continued)

*Primary Examiner* — Nathan Empie
(74) *Attorney, Agent, or Firm* — David B. Patchett

(57) ABSTRACT

An article comprising a roll of tape having a coating composition disposed on a first edge face is disclosed herein. A coating composition may be disposed on a second edge face that opposes the first edge face. The coating compositions may be cured. A method for edge coating the roll of tape is also disclosed herein, as well as a method for coating a plurality of articles having different dimensions.

22 Claims, 5 Drawing Sheets

U.S. PATENT DOCUMENTS

| | | | |
|---|---|---|---|
| 5,804,256 | A | 9/1998 | Schäfer |
| 5,863,620 | A | 1/1999 | Schäfer |
| 5,939,161 | A | 8/1999 | Callahan, Jr. et al. |
| 6,026,748 | A | 2/2000 | Reed et al. |
| 7,063,744 | B2 | 6/2006 | Komatsu et al. |

FOREIGN PATENT DOCUMENTS

| | | | |
|---|---|---|---|
| EP | 0 648 715 | A2 | 4/1995 |
| GB | 2 073 611 | | 10/1981 |
| JP | JUM-A-51-071861 | | 12/1974 |
| JP | 50-10353 | | 4/1975 |
| JP | 59-43083 | | 9/1982 |
| JP | 58038776 | | 3/1983 |
| JP | 59-159874 | | 9/1984 |
| JP | 62-42759 | | 2/1987 |
| JP | A-2-122865 | | 11/1988 |
| JP | 05065461 | | 2/1991 |
| JP | 05065461 | A * | 3/1993 |
| JP | 8-173870 | | 7/1996 |
| JP | 7-93806 | | 10/1996 |
| WO | WO98/13199 | | 4/1998 |

OTHER PUBLICATIONS

Kirk-Othmer, Encyclopedia of Chemical Technology, Third Edition, vol. 6, "Coating Processes", pp. 386-426.

Kirk-Othmer, Encyclopedia of Chemical Technology, Third Edition, vol. 20 "Radiation Curing", pp. 832-834 (1996).

Mayzo RA-23 Release Coat product literature Dec. 16, 1996 (2 pages).

Mayzo Material Safety Data Sheet RA-23 Release Coat May 21, 1997 (3 pages).

* cited by examiner

EDGE COATED ROLL OF TAPE AND METHOD OF MAKING SAME

CROSS-REFERENCE TO RELATED APPLICATION

This application is a continuation of U.S. Ser. No. 09/808,584, filed Mar. 14, 2001 now U.S. Pat. No. 7,669,547, the disclosure of which is incorporated by reference in its entirety herein.

BACKGROUND OF THE INVENTION

The invention is directed to coating articles.

A roll of pressure sensitive adhesive tape is often prepared by applying a pressure sensitive adhesive composition to a backing and then winding the backing on a cylindrical core to form the roll of tape. The edge face of the roll of tape often includes exposed pressure sensitive adhesive, which renders the edge face tacky. In addition, when the tape is wound upon a cylindrical core to form a roll, uneven winding may occur which may cause variations in the edge face surface.

Multiple rolls of pressure sensitive adhesive tape are often packaged in a stack. When rolls of pressure sensitive adhesive tape are stacked on top of one another they tend to block, i.e., stick together. Blocking tends to increase in frequency and degree over time and at elevated temperatures, e.g., above room temperature. The edge face of a roll of tape may also stick to its packaging, which can make removal of the roll of tape from the packaging difficult. Electrical tape, for example, which is often sold in plastic containers, tends to stick to the plastic walls of the container. The tacky nature of the edge face also tends to pick up dust, dirt and other particulate debris from the environment.

A number of methods have been developed to protect the edge face of a roll of adhesive tape or detackify the exposed adhesive on the edge face. One common method involves placing a sheet of paper in contact with the edge face, e.g., between two rolls of tape. Another method involves coating the edge face of a roll of tape with very small glass beads. The glass beads tend to fall off the roll, which can cause contamination or damage to manufacturing processes and machinery. Other methods include applying a detackifying agent to the edge of a strip of tape using a sponge or a cloth prior to winding the strip of tape upon a cylindrical core to form a roll.

SUMMARY

An article comprising a roll of tape having a coating composition disposed on a first edge face is disclosed herein. A coating composition may be disposed on a second edge face that opposes the first edge face. The coating compositions may be cured. A method for edge coating the roll of tape is also disclosed herein, as well as a method for coating a plurality of articles having different dimensions.

In one aspect, the invention features an apparatus for coating an article, the apparatus comprising an applicator, a conveyor for sequentially transporting a plurality of articles to the applicator and a metering bar positioned against the applicator to meter a predetermined amount of coating composition to the applicator for transfer to an article transported to the applicator by the conveyor. In one embodiment, the applicator includes a roller having a durometer of no greater than about 55 Shore A. In another embodiment, the coating apparatus is capable of applying a substantially uniform layer of coating composition on a plurality of articles having different dimensions.

In some embodiments, the end of the metering bar positioned against the roller has a radius of at least about 2.5 mm. In other embodiments, the end of the metering bar positioned against the roller has a radius of at least about 4.0 mm. In another embodiment, the metering bar exerts a force of at least about 35 g/cm width against the applicator. In some embodiments, the metering bar exerts a force of from about 45 g/cm width to about 900 g/cm width against the applicator.

In one embodiment, the conveyor is positioned relative to the applicator such that the applicator is capable of coating the edge face of a roll of tape disposed between the conveyor and the applicator. In one embodiment, the applicator is a roller. In other embodiments, the applicator is an endless belt.

In other embodiments, the apparatus further includes a second applicator and a second metering bar positioned against the second applicator to meter a predetermined amount of coating composition to the second applicator, the second applicator being positioned to receive an article from the conveyor. In one embodiment, the first applicator is a roller and the second applicator is a roller. In other embodiments, the first applicator includes an endless belt. In some embodiments, the second applicator includes an endless belt.

In another embodiment, the apparatus is capable of substantially simultaneously transferring a coating composition from the first applicator to a first side of an article, and transferring a coating composition from the second applicator to a second side of the article opposite the first side of the article. In some embodiments, the article is a roll of tape and the apparatus is capable of substantially simultaneously transferring a coating composition from the first applicator to a first edge face of a roll of tape and transferring a coating composition from the second applicator to a second edge face of the roll of tape opposite the first edge face of the roll of tape.

In one embodiment, the first applicator and the second applicator are positioned to maintain an article between the first applicator and the second applicator.

In another aspect, the invention features a system for manufacturing coated articles, the system including a first station comprising a coating apparatus that includes an applicator, a conveyor capable of sequentially transporting a plurality of articles to the applicator, and a metering bar positioned against the applicator to meter a predetermined amount of coating composition to the applicator for transfer to an article transported to the applicator by the conveyor, and a second station for solidifying the coating composition disposed on the article.

In some embodiments, the applicator includes a roller. In other embodiments, the applicator includes an endless belt.

In another embodiment, the conveyor is capable of transporting a coated article to the second station.

In other embodiments, the system further includes a second conveyor capable of transporting a coated article from the first station to the second station. In one embodiment, the system further includes a second conveyor comprising a first endless belt and a second endless belt, the second conveyor being positioned to transport a coated article to the second station. In some embodiments, the system further includes a second applicator positioned to receive an article from the conveyor, and a second metering bar positioned against the second applicator to meter a predetermined amount of coating composition to the second applicator. In another embodiment, the system further includes a second applicator positioned opposite the first applicator, and a second metering bar positioned against the second applicator to meter a predetermined amount of coating composition to the second applicator. In one embodiment, the system further includes a second conveyor positioned to transport a coated article to the second station. In another embodiment, the system further includes a second conveyor comprising a first endless belt and a second endless belt, the second conveyor being positioned to transport a coated article to the second station. In one embodiment, the second conveyor is capable of transporting a coated article between the first endless belt and the second endless belt.

In some embodiments, the second station includes a source of radiation. In one embodiment, the source of radiation is capable of generating radiation selected from the group consisting of ultraviolet radiation and electron beam radiation. In other embodiments, the solidifying includes curing. In yet other embodiments, the solidifying includes drying.

In another aspect, the invention features a method of coating an article using a coating apparatus comprising an applicator, a conveyor for transporting an article the applicator, and a metering bar positioned against the applicator to meter a predetermined amount of coating composition to the applicator, the method including applying a liquid coating composition to the applicator and transferring the coating composition from the applicator to the article. In some embodiments, the coating composition has a viscosity of at least about 15 cps. In other embodiments, the coating composition has a viscosity of at least about 19 cps. In one embodiment, the method further includes curing the coated composition. In another embodiment, the method further includes drying the coated composition In some aspects, the invention features a method of coating the edge face of a roll of tape using a coating apparatus that includes an applicator, a conveyor for transporting a roll of tape to the applicator, and a metering bar positioned against the applicator to meter a predetermined amount of coating composition to the applicator, the method including applying a liquid coating composition to the applicator, and transferring the coating composition from the applicator to the edge face of the roll of tape. In one embodiment, the composition has a viscosity of at least about 15 cps. In other embodiments, the composition has a viscosity of at least about 19 cps.

In some embodiments, the end of the metering bar positioned against the applicator has a radius of at least about 3 mm. In other embodiments, the end of the metering bar positioned against the applicator has a radius of at least about 4 mm. In one embodiment, the metering bar exerts a force of at least about 35 g/cm width against the applicator. In other embodiments, the metering bar exerts a force of from about 45 g/cm width to about 900 g/cm width against the applicator.

In another embodiment, the conveyor is positioned relative to the applicator such that the applicator is capable of coating the edge face of a roll of tape disposed between the conveyor and the applicator. In one embodiment, the method further includes a second applicator positioned to receive an article from the conveyor, and a second metering bar positioned against the second applicator to meter a predetermined amount of coating composition to the second applicator.

In some embodiments, the method further includes a second applicator positioned opposite the first applicator, and a second metering bar positioned against the second applicator to meter a predetermined amount of coating composition to the second applicator.

In one embodiment, the method further includes curing the composition coated on the edge face. In other embodiments, the method further includes drying the composition coated on the edge face.

In some embodiments, the method further includes substantially simultaneously transferring a coating composition to a first side of an article and a second side of the article opposite the first side of the article. In one embodiment, the article is a roll of tape and the method further includes substantially simultaneously transferring a coating composition to a first edge face of the roll of tape and a second edge face of the roll of tape.

In other aspects, the invention features an apparatus for coating an article, where the apparatus includes an applicator roller, a conveyor for sequentially transporting a plurality of articles to the roller and a metering bar positioned against the roller to meter a predetermined amount of coating composition to the roller for transfer to an article positioned between the roller and the conveyor.

The coating apparatus is capable of applying a reproducible coating weight to the surface of a series of articles upon each revolution of the applicator roller. The coating apparatus is well suited to coating the edge face of a roll of tape. The coating apparatus can coat articles that are spaced at irregular intervals on the conveyor that feeds the articles into the apparatus, i.e., the interval between articles to be coated can be varied. The apparatus is also well suited to applying a coating to a number of articles each having a surface to be coated that differs in dimension from the previous article.

The coating apparatus is constructed such that when an article is not available for coating, the liquid coating composition is not transferred from the roller. The coating apparatus is also capable of controlling the amount of coating composition applied to the roller such that overcoating, i.e., applying coating composition to surfaces other than the target surface, does not occur. In the case of rolls of tape, for example, the coating apparatus is capable of coating surface variations present at the edge face of the roll of tape, while avoiding coating the vertical surfaces of the roll of tape such as the cylindrical core of the roll and the exposed backing of the roll.

Other features and advantages will be apparent from the following description of the preferred embodiments thereof, and from the claims. In the figures, like numbers are used to represent like elements.

DETAILED DESCRIPTION

Figure 1:
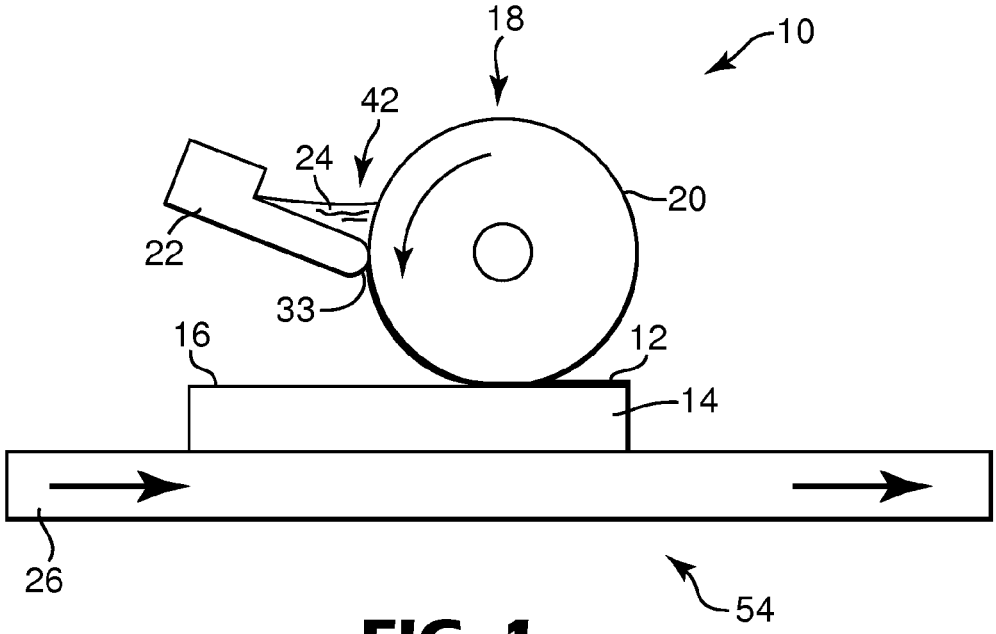
FIG. 1 is a side view of a coating apparatus.

The coating apparatus is suitable for coating a variety of articles including articles having a variety of different shapes and sizes. For ease of description, however, the coating apparatus is described herein with respect to coating the edge face of a roll of tape.

FIGS. 1-4 illustrate a coating apparatus 10 for applying a liquid coating composition 24 on an edge face 16 of a roll of tape 14. The coating apparatus 10 includes an applicator 18 in the form of a roller, a metering bar 22 in contact with the applicator roller 18 and a conveyor 26. The metering bar 22 is positioned such that an edge 33 of the metering bar 22 bears on the surface of the applicator roller 18. The metering bar 22 and applicator roller 18 combine to define a trough 42, which receives the liquid coating composition 24. The force with which the metering bar presses against the applicator roller 18 and the angle at which the arcuate end portion 31 of the metering bar 22 contacts the applicator roller 18 control the amount of coating composition 24 that is carried by the applicator roller 18 as it rotates past the metering bar 22 in a counter clock wise direction.

The conveyor 26 is positioned beneath the applicator roller 18 at a vertical distance from the applicator roller 18 sufficient to permit a roll of tape 14 positioned with an edge face 16 in contact with the conveyor 26 to pass between the applicator roller 18 and the conveyor 26. As the conveyor 26 moves, it transports a roll of tape 14 to the applicator roller 18. As the leading edge of the roll of tape 14 enters the coating station 54, the applicator roller 18 contacts the edge face 16 and transfers a layer 12 of coating composition 24 to the edge face 16. The rotation of the applicator roller 18 in a counter clockwise direction provides fresh coating composition 24 to the edge face 16 as it travels through the coating station 54.

The liquid composition 24 is applied to the edge face 16 at a predetermined coating weight to provide a coating thickness "X" on the roll of tape. Suitable coating weights will vary depending upon factors related to the roll of tape including, e.g., the composition of the adhesive, the coating weight of the adhesive and the backing of the roll of tape and the surface variations on the edge face of the roll of tape. The apparatus 10 is capable of applying the liquid composition 24 to the edge face 16 without applying the composition to the interior of the central cylinder 32 or the major surface of the exposed backing 30 of the roll of tape 14.

Suitable applicator roller materials are conformable to the surface of the article being coated. The roller can include a single material extending through the body of the roller or multiple layers of material. Preferably the exposed roller material is sufficiently conformable to apply a substantially uniform layer of coating composition on a surface having height variations. The roller can also be constructed to include one material or a number of layers of the same or different material. Roller constructions that include multiple layers preferably have a conformable outer surface layer. The applicator roller can be made from a variety of materials including, e.g., nitrile rubber, vinyl modified nitrile rubbers, and urethane. The density of the applicator roller can also vary from a solid to a porous foam construction having open cell pores, closed cell pores, or a combination thereof. Useful rollers have a hardness of from about 12 Shore A to about 55 Shore A, preferably about 24 Shore A.

Figure 12:
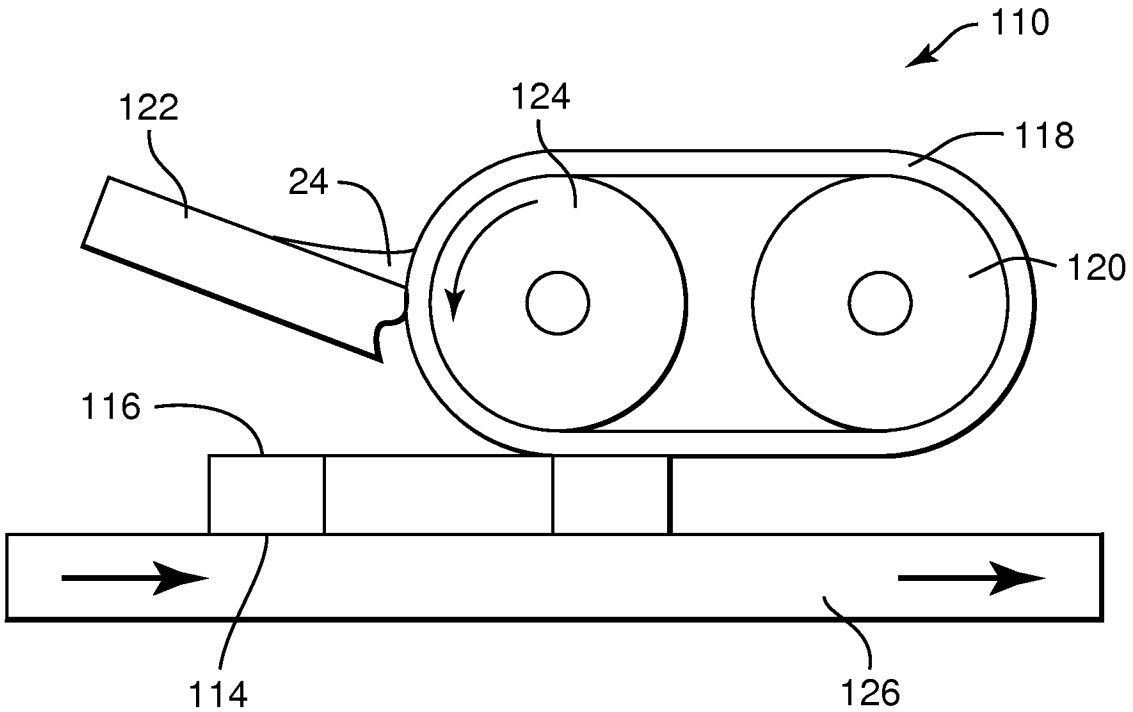
FIG. 12 is a side view of a coating apparatus that includes an endless belt.

Alternately, the applicator can be an endless belt. FIG. 12 illustrates a coating apparatus 110 that includes an endless belt 118 that travels around two rotating pulleys 120, 124. A metering bar 122 applies a pressure against the endless belt 118. A coating composition 24 is fed to the nip between the metering bar 122 and the endless belt 118. As the endless belt 118 moves it transports coating composition 24 and applies coating composition 24 to an edge face 116 of a roll of tape 114, which is brought into position under the endless belt 118 by conveyor 126.

The metering bar 22 is a bar that is capable of controlling the amount of coating composition applied to the applicator roller 18 such that each revolution of the applicator roller carries substantially the same amount of coating composition for transfer to the article to be coated. A number of suitable metering bar constructions are available including, e.g., a doctor blade, a doctor blade that includes a gap (e.g., an adjustable gap) as shown, e.g., in FIG. 8, and a doctor blade that includes a rotatable rod as shown, e.g., in FIG. 11. The portion of the metering bar positioned against the applicator can have a smooth or patterned surface.

Figure 2:
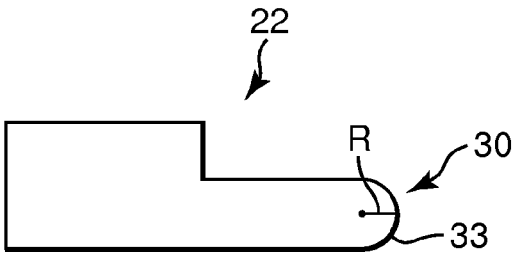
FIG. 2 is a side view of the metering bar of the coating apparatus of FIG. 1.
Figure 3:
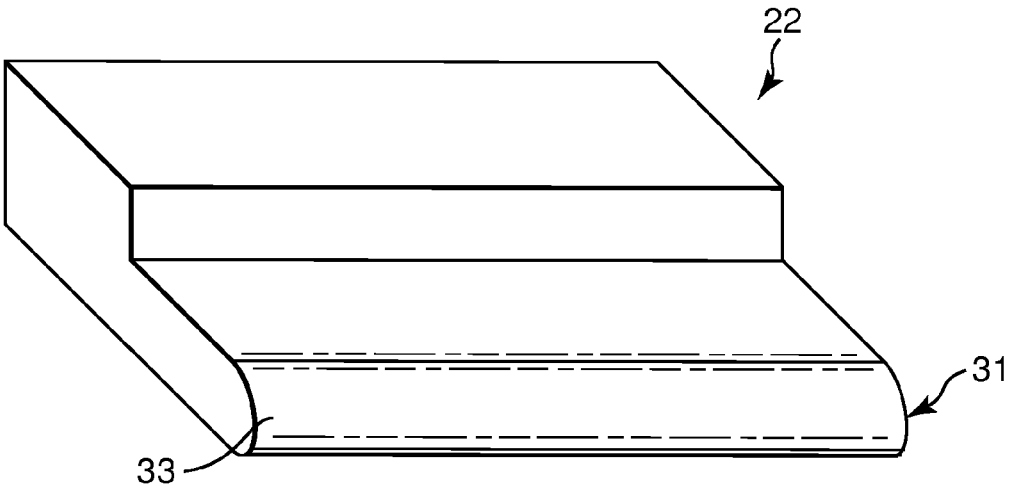
FIG. 3 is a perspective view of the metering bar of FIG. 2.
Figure 4:
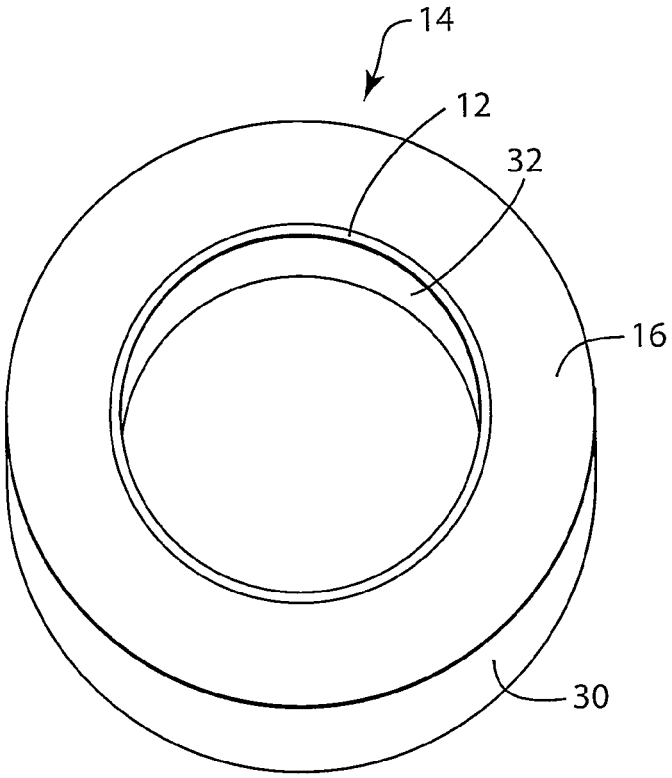
FIG. 4 is a perspective view of a roll of tape.

The metering bar 22 of FIGS. 1-3 is in the form of a doctor blade having an arcuate end portion 31. The arcuate end portion 31 is positioned and exerts a force against the applicator roller 18 during the coating process. The arcuate end portion 31 is defined by a radius "R."The radius "R" of the doctor blade 22 can be used to alter the coating weight applied to the edge face 16 of the roll of tape 14. Increasing the radius of the arcuate end portion 31 of the doctor blade 22 can cause an increase in the hydraulic force at the nip between the doctor blade 22 and the applicator roller 18, which causes an increase in the coating weight applied to the edge face 16 of the roll of tape 14. Decreasing the radius R of the arcuate end portion 31 of the doctor blade 22 can decrease the coating weight applied to the edge face 16 of the roll of tape 14. Preferably the doctor blade has a radius of at least 2.5 mm, more preferably at least about 3 mm, most preferably from about 2.5 mm to about 80 mm.

The force exerted by the metering bar 22 against the applicator roller 18 can also alter the coating weight of the composition applied to the surface of the edge face. Increasing the force, for example, decreases the coating weight and decreasing the force increases the coating weight. Preferably the force exerted by the metering bar is from 0.25 lb/inch width to about 5.0 lb/inch width of the metering bar.

The coating apparatus can be used to transfer coating compositions having a wide range of viscosities including compositions having a viscosity of from about 15 centipoise (cps) to greater than 10,000 cps.

The coating apparatus can be constructed such that the applicator roller rotates continuously. The applicator roller can be connected to a motor capable of controlling the rotation as well as the rotation speed of the roller. When a roll of tape is not present in the coating position, the applicator roller can continue rotating without depositing the coating composition.

Figure 5:
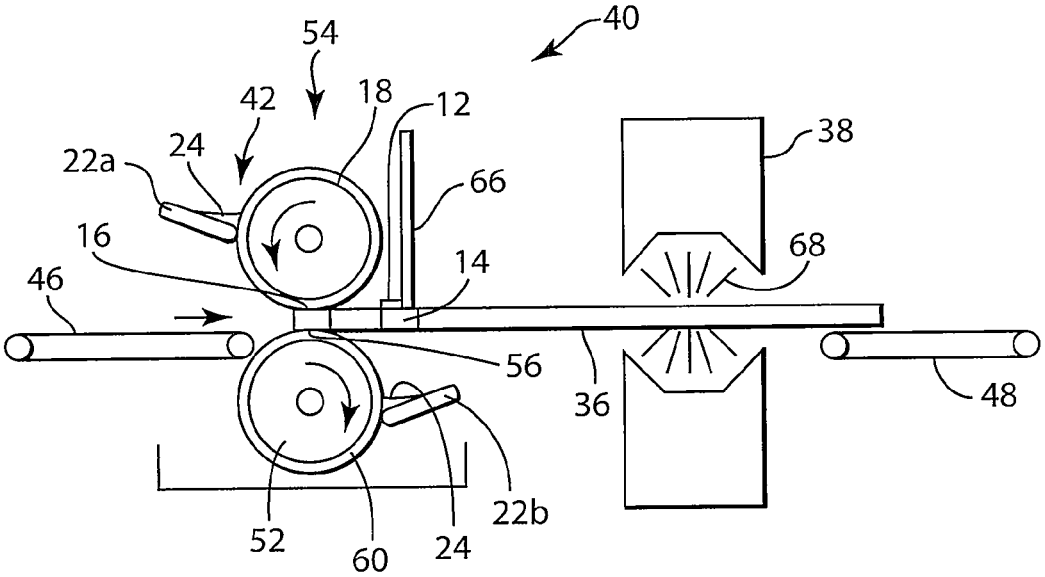
FIG. 5 is a side view of a coating apparatus according to a second embodiment.
Figure 6:
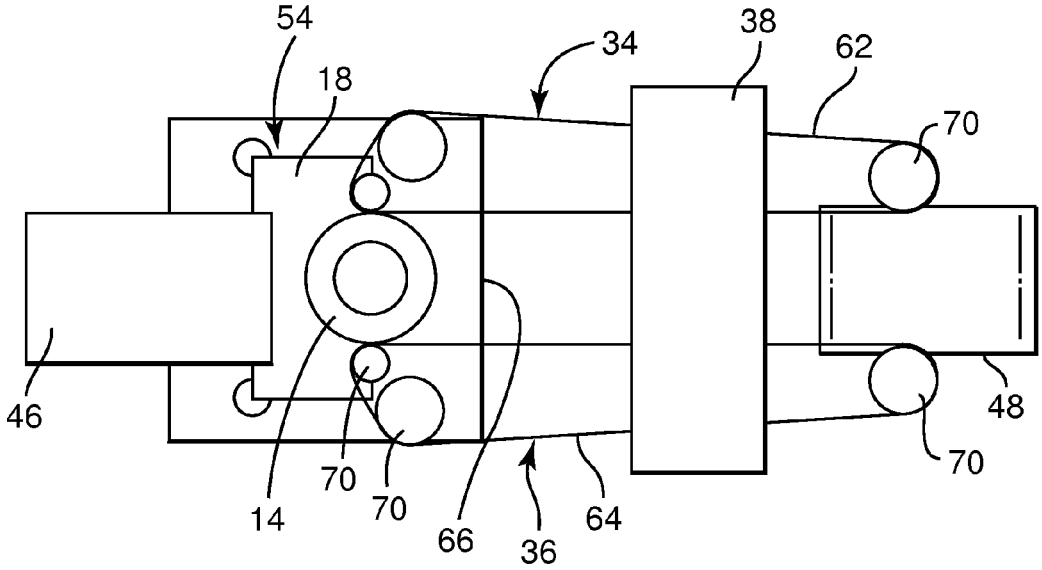
FIG. 6 is a top view of the coating apparatus of FIG. 5.

FIGS. 5 and 6 illustrate a second embodiment of a coating apparatus 40, which is part of a coating process that includes a coating station 54 and a finishing station 38. The coating apparatus 40 includes a second roller 52 positioned opposite the first roller 18 to enable simultaneous coating of the first and second edge faces 16, 56 of the roll of tape 14. The second roller 52 is also conformable to the surface variations present on edge face 56 and includes a conformable outer layer 60. As roller 52 rotates clockwise about its axis a metering bar 22*a* meters a predetermined amount of liquid composition 24 to the second roller 52.

A conveyor 46 feeds a roll of tape 14 into the space between the rollers 18, 52. The movement of the first roller 18 in a counter clockwise direction and the second roller 52 in a clockwise direction causes the roll of tape 14 to be taken up by and passed between the two rollers 18, 52. The rollers 18, 52 then transfer a layer 12 of liquid coating composition 24 to the opposite edge faces 16, 56 of the roll of tape 14 while simultaneously advancing the roll of tape 14 to the transport conveyors 34, 36.

The roll of tape 14 leaves the coating apparatus 40 via transport conveyors 34, 36, which include two endless belts 62, 64 traveling around rotating pulleys 70. The transport conveyors 34, 36 grip the roll of tape 14 as it exits from between the rollers 18, 52. The transport conveyors 34, 36 maintain the roll of tape 14 between them by friction. The roll of tape 14 is preferably maintained in a level position as it is transported from the coating station 54, past the blocking panel 66 and to a finishing station 38 by the transport conveyors 34, 36. The blocking panel 66 can block radiation, e.g., light or heat, transmitted from the finishing station 38 from reaching the coating station 54. As the roll of tape 14 passes through the finishing station 38 the layers 12 of coating composition 24 on the edge faces 16, 56 of the roll of tape 14 are treated, e.g., exposed to radiation 68 for a period sufficient to cure the layers 12 of coating composition 24 in the case of a curable coating composition or dried (e.g., by heat or air) in the case of a water-based or solvent-based coating composition. The roll of tape 14 is then transported out of the finishing station 38 to conveyor 48 for further processing including, e.g., packaging.

The coating apparatus is suitable for coating a variety of compositions including, e.g., solid (e.g., hot melt and radiation curable compositions), aqueous-based and solvent-based compositions. The coating apparatus can coat compositions having a wide range of viscosities and is well suited to coating compositions having a viscosity from about 15 cps to about 15,000 cps, preferably no greater than about 10,000 cps, most preferably no greater than about 5,000 cps.

The coating apparatus is also suitable for coating a variety of articles having varying shapes and dimensions including, e.g., piece parts.

Figure 7:
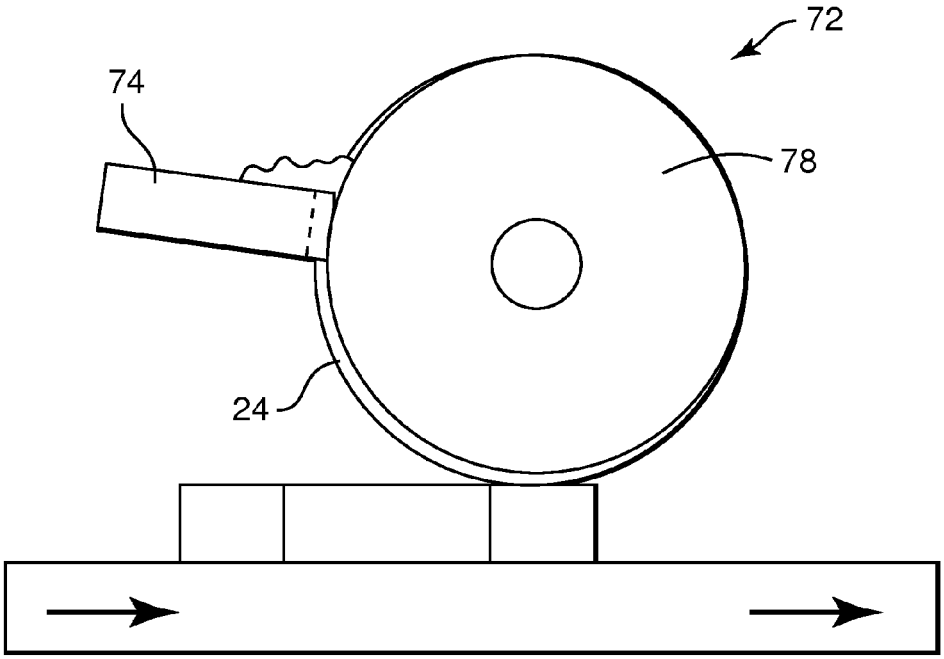
FIG. 7 is a side view of a coating apparatus according to a third embodiment.
Figure 8:
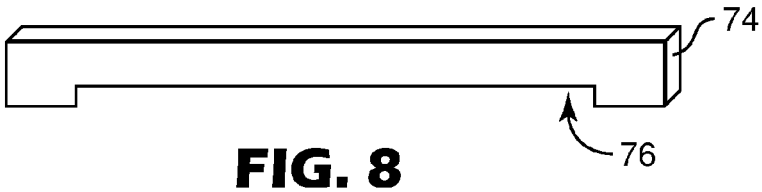
FIG. 8 is a front perspective view of the metering bar and applicator roller of the coating apparatus of FIG. 7.
Figure 9:
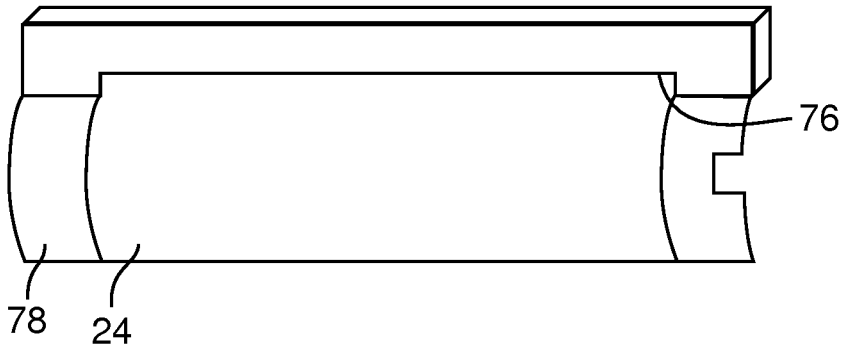
FIG. 9 is a front view of the metering bar of FIG. 8.

Other embodiments are within the claims. FIGS. 7-9, for example, illustrate a coating apparatus 72 that includes a metering bar 74 in the form of a doctor blade 74 that includes a gap 76 in contact with applicator roller 78. The gap 76 meters the amount of coating composition 24 that is applied to the applicator roller 78. A gap doctor blade 74 is capable of applying a greater volume of coating composition to the applicator roller 18 relative to a doctor blade without a gap. A gap doctor blade is particularly useful for coating aqueous-based compositions.

Figure 10:
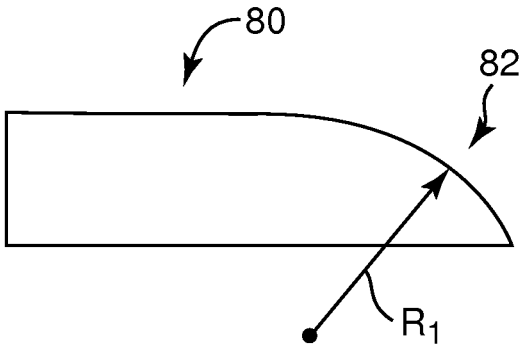
FIG. 10 is a side view of a second embodiment of a metering bar.

FIG. 10 illustrates a metering bar 80 that includes an arcuate portion 82 defined by radius "R1" and having a straight edge. In use, the arcuate portion 82 of the metering bar 80 is in contact with the applicator roller 18.

Figure 11:
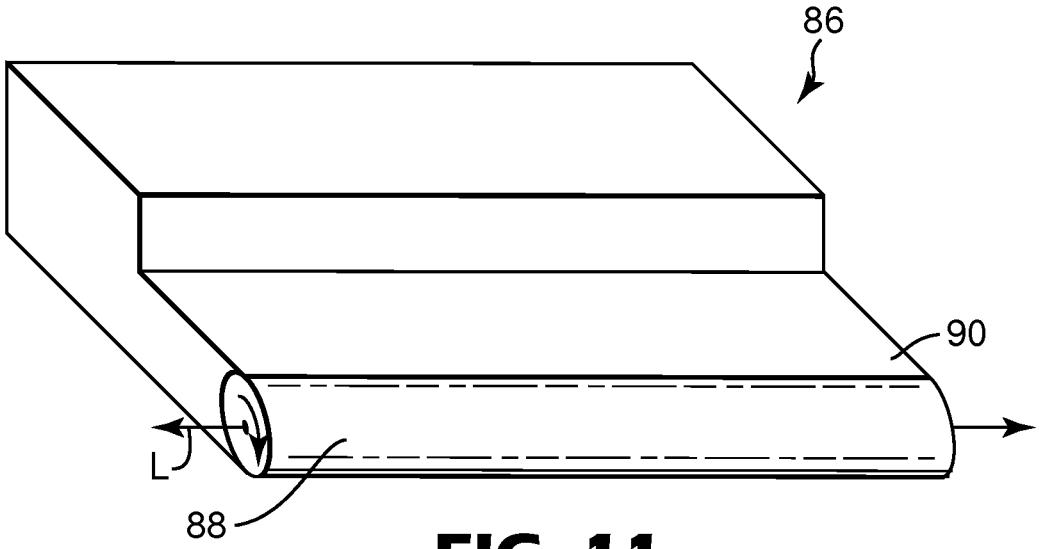
FIG. 11 is a perspective view of a third embodiment of a metering bar.

FIG. 11 illustrates a metering bar 86 that includes a rotatable rod 88 disposed in the applicator-contacting end 90 of the metering bar 86. The rod 88 is capable of rotating about its longitudinal axis L. The rod 88 can be rotated at predetermined speeds, at predetermined intervals and in predetermined directions, to provide various functions including, e.g., refreshing the arcuate surface available for contact with the applicator, and cleansing the nip between the rod and the applicator. Cleansing the nip and refreshing the arcuate surface can help remove tracks and streaks formed on the applicator roller. The rotatable rod 88 is preferably a hard, dense material including, e.g., metal (e.g., steel, iron or aluminum and alloys thereof) and plastic.

What is claimed is:

1. A method of coating the edge face of a roll of tape, the method comprising:

sequentially transporting a plurality of rolls of tape on a conveyor to a first applicator of a coating apparatus;

metering a predetermined amount of a coating composition to the first applicator using a first metering bar positioned against the first applicator; and transferring the coating composition from the first applicator to a first edge face of a first roll of tape.

2. The method of claim 1, wherein the first applicator comprises a roller having a durometer of no greater than about 55 Shore A.

3. The method of claim 1, wherein the applicator comprises a roller, the first metering bar comprises an end, and the end of the first metering bar is positioned against the roller and has a radius of at least about 4.0 mm.

4. The method of claim 3, wherein the roller has a durometer of no greater than about 55 Shore A.

5. The method of claim 3, wherein the first metering bar exerts a force of from about 45 g/cm width to about 900 g/cm width against the first applicator.

6. The method of claim 3, wherein the apparatus further comprises a second applicator and a second metering bar positioned against the second applicator to meter a predetermined amount of a coating composition to the second applicator for transfer to a second edge face of a roll of tape transported to the second applicator by the conveyor.

7. The method of claim 6, wherein the first and second applicators substantially simultaneously apply the coating compositions to the first and second edge faces, respectfully.

8. The method of claim 6, wherein the first and second applicators are positioned to maintain the article between the first and second applicators.

9. The method of claim 3 further comprising curing the coating composition disposed on the first edge face of the roll of tape.

10. The method of claim 1, wherein the first metering bar exerts a force of from about 45 g/cm width to about 900 g/cm width against the first applicator.

11. The method of claim 1, wherein the first applicator comprises a roller.

12. The method of claim 1, wherein the first applicator comprises an endless belt.

13. The method of claim 1, wherein the apparatus further comprises a second applicator and a second metering bar positioned against the second applicator to meter a predetermined amount of a coating composition to the second applicator for transfer to a second edge face of the roll of tape transported to the second applicator by the conveyor.

14. The method of claim 13, wherein the first and second applicators substantially simultaneously apply the coating compositions to the first and second edge faces, respectfully.

15. The method of claim 13, wherein the first and second applicators are positioned to maintain the article between the first and second applicators.

16. The method of claim 1, wherein the coating composition has a viscosity of at least about 19 cps.

17. The method of claim 1, wherein the apparatus further comprises a station for curing the coating composition disposed on the edge face of the roll of tape.

18. The method of claim 17, the method further comprising curing the coating composition disposed on the edge face of the roll of tape.

19. The method of claim 1, wherein the first metering bar comprises an arcuate end and the arcuate end is positioned against the first applicator.

20. The method of claim 1, wherein the applicator comprises an endless belt, the first metering bar comprises an end, and the end of the first metering bar is positioned against the endless belt and has a radius of at least about 4.0 mm.

21. The method of claim 1, wherein the first applicator is conformable to the edge face of a roll of tape and applies a uniform layer of coating composition on the edge face of the roll of tape.

22. The method of claim 1, wherein the first metering bar forms a nip with the first applicator and a hydraulic force at the nip correlates to the coating weight of the composition applied to the surface of the edge face.

* * * * *